US008708302B2

(12) United States Patent
Wilder

(10) Patent No.: US 8,708,302 B2
(45) Date of Patent: Apr. 29, 2014

(54) WALL CALENDAR HOLDER APPARATUS

(76) Inventor: Stan G. Wilder, Culpeper, VA (US)

( * ) Notice: Subject to any disclaimer, the term of this patent is extended or adjusted under 35 U.S.C. 154(b) by 158 days.

(21) Appl. No.: 13/191,684

(22) Filed: Jul. 27, 2011

(65) Prior Publication Data

US 2013/0026330 A1 Jan. 31, 2013

(51) Int. Cl.
*A47F 7/14* (2006.01)
*A47G 1/16* (2006.01)

(52) U.S. Cl.
USPC ..... 248/475.1; 248/452; 40/107; 40/120

(58) Field of Classification Search
USPC ..... 248/475.1, 452, 447.1, 468, 467, 316.3; 40/119, 107, 120
See application file for complete search history.

(56) References Cited

U.S. PATENT DOCUMENTS

| | | | | | |
|---|---|---|---|---|---|
| 1,849,243 | A | * | 3/1932 | Moore | 402/61 |
| 3,208,171 | A | * | 9/1965 | Saxe | 40/120 |
| 3,399,429 | A | | 9/1968 | Goodman | |
| 3,612,709 | A | * | 10/1971 | Miyamoto | 402/2 |
| 3,727,829 | A | * | 4/1973 | Huni | 383/203 |
| 3,814,368 | A | | 6/1974 | Freed | |
| 4,085,848 | A | | 4/1978 | Tsuge | |
| 4,105,127 | A | | 8/1978 | Holl | |
| 4,237,856 | A | * | 12/1980 | Trombatore | 126/299 C |
| 4,899,974 | A | | 2/1990 | Wear et al. | |
| 4,983,047 | A | * | 1/1991 | Netto | 383/5 |
| 5,096,069 | A | | 3/1992 | Brandon | |
| 6,158,597 | A | | 12/2000 | McDermott | |
| 6,182,938 | B1 | | 2/2001 | Wright | |
| 6,253,473 | B1 | * | 7/2001 | Collins | 40/120 |
| 6,302,366 | B1 | * | 10/2001 | Saylor et al. | 248/452 |
| 6,345,456 | B1 | | 2/2002 | Bracken | |
| 6,574,894 | B1 | | 6/2003 | Hamilton | |
| 7,128,301 | B2 | | 10/2006 | Shepard et al. | |
| 7,866,070 | B2 | | 1/2011 | Beyer, Jr. | |
| 2003/0066217 | A1 | | 4/2003 | Graham | |
| 2004/0111928 | A1 | | 6/2004 | Gavronsky | |
| 2006/0226329 | A1 | | 10/2006 | Kim | |
| 2007/0193077 | A1 | | 8/2007 | Brown | |
| 2011/0068246 | A1 | | 3/2011 | Beyer, Jr. | |

FOREIGN PATENT DOCUMENTS

| | | | |
|---|---|---|---|
| JP | 07-214944 | A | 8/1995 |
| JP | 2002-036769 | A | 2/2002 |

* cited by examiner

*Primary Examiner* — Nkeisha Smith
(74) *Attorney, Agent, or Firm* — Kile Park Reed & Houtteman, PLLC

(57) ABSTRACT

A wall calendar holder that includes a base plate operable to be attached to a vertical surface and a face plate pivotally connected to the base plate. A stanchion extends from a central portion of the base plate and operable serves to support a wall calendar. The face plate snaps into engagement with the stanchion and the combination of the base member and face member serve to hold an upper edge of the wall calendar is a secure and flush condition upon a vertical presentation surface.

1 Claim, 3 Drawing Sheets

WALL CALENDAR HOLDER APPARATUS

BACKGROUND OF THE INVENTION

This invention relates to an apparatus for securing a wall calendar. More specifically, the invention comprises an apparatus for holding a top edge portion of a wall calendar in a laterally flat condition along a generally vertical wall surface.

In the past calendars have been produced in a variety of forms such as desk top leaf calendars, notebook calendars, book calendars, pocket day calendars, electronic calendars, etc. One particularly popular form has been a picture or image wall calendar. In this a calendar month is usually displayed on a bottom portion or half of a hanging wall calendar and an upper portion depicts scenic landscape views, nature scenes, hobby views, model images, personalized photographic images, etc. In addition many wall calendars include advertising information or space to record notes and/or personalized information.

Wall calendars of the above type are usually constructed with twelve sheets of paper stock of varying grade but range from quite thin and flexible and thus relatively inexpensive to rather heavy glossy photograph quality paper. Wall calendars are usually produced with a stapled lateral fold across the center of each page. On the bottom half the January through December months of a year are displayed with one month occupying one page and a separate or distinctive image is displayed on the top half of each month.

In order to mount a wall calendar onto a generally vertical wall surface a single central hole is usually cut through an upper edge of the picture portion and the calendar is then the calendar is hung on a wall surface from a nail, a hook or some similar support substitute. Although wall calendars are quite popular they do not often hang well over the course of a year period. In this, the outer corners of some wall calendars tend to curl or droop at the upper edges. In addition as months pass and individual pages of a calendar are turned the single hole for hanging purposes can experience wear and become unstable. This condition detracts from the overall appearance and utility of the calendar, however, even in the fall months of a year it is desirable to have a relatively fresh and neat appearance of the calendar since wall calendars are often hung in visible locations.

It would be highly desirable to provide an apparatus for attractively mounting a wall calendar to a generally vertical wall surface which is relatively inexpensive to produce yet rugged and functional over a number of years without displaying noticeable deterioration in any calendar year or in the mounting apparatus over a number of calendar years.

The problems and desires suggested in the preceding are not intended to be exhaustive but rather are among many which may tend to reduce the effectiveness, reliability and desirability of previously known wall calendars. Other noteworthy problems may also exist; however, those presented above should be sufficient to demonstrate that wall calendar hanging arrangements appearing in the past will admit to worthwhile improvement.

THE DRAWINGS

Numerous advantages of the present invention will become apparent from the following detailed description of preferred embodiments taken in conjunction with the accompanying drawings wherein.

Figure 3:
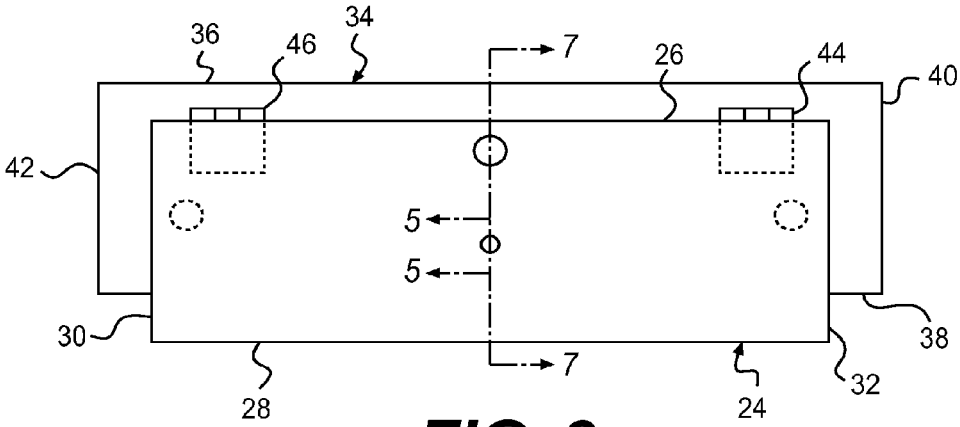
FIG. 3 is back panel view of an embodiment of the wall calendar hanging apparatus of the subject invention disclosing a wall hanging aperture operable to engage a nail or hook on a wall surface.
Figure 4:
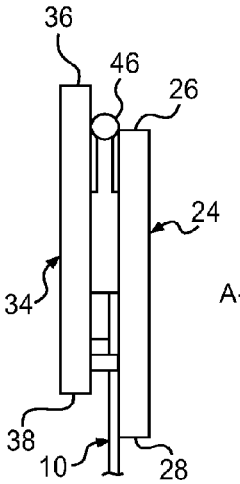
FIG. 4 is side view of the subject wall calendar hanger apparatus depicted in FIGS. 1-3.
Figure 6:
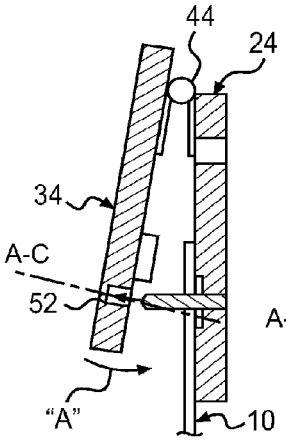
Figure 7:
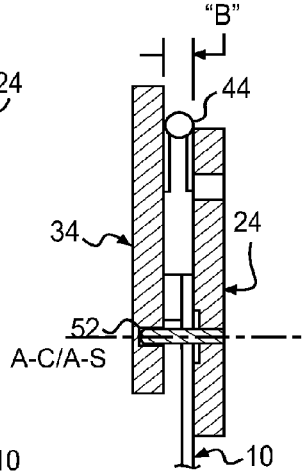

FIG. 6 is a cross-sectional view taken along a central portion of the wall calendar holder and discloses the subject calendar hanger apparatus in the process of being closed to support a paper wall calendar upon a wall calendar; and FIG. 7 is a cross-sectional view taken along section lines 7-7 in FIG. 3 and discloses the subject calendar hanger apparatus in a closed position to secure a calendar upon a wall surface.

DETAILED DESCRIPTION

Figure 1:
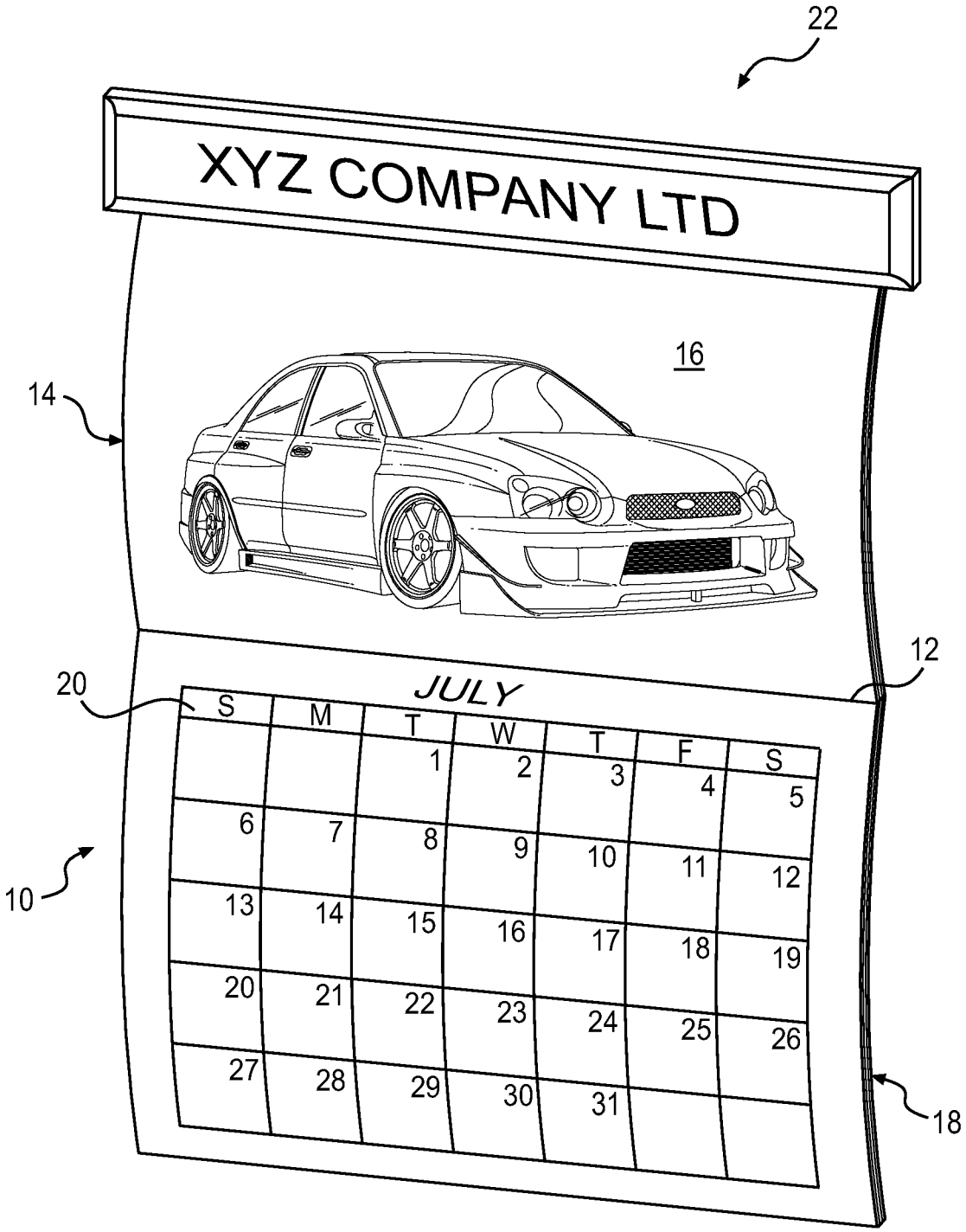
FIG. 1 is an axonometric view of a wall calendar supported upon a generally vertical wall surface by one embodiment of the subject invention.
Figure 2:
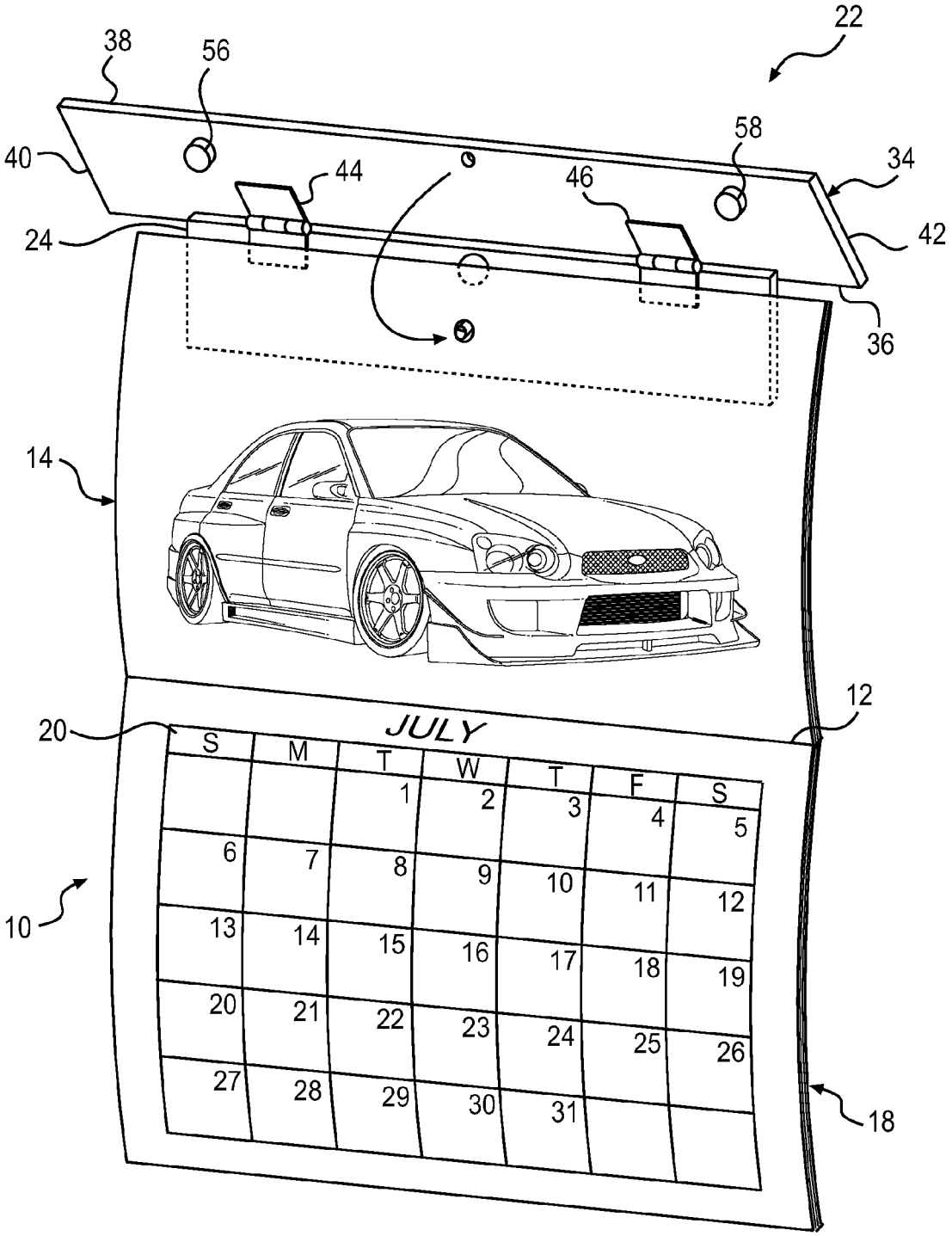
FIG. 2 is an axonometric view similar to FIG. 1 but with an exterior panel of the subject wall calendar holder pivoted upwardly to disclose application of the wall hanging apparatus to a conventional wall calendar.

Turning now to the drawings wherein like numerals refer to like parts FIG. 1 discloses an axonometric or pictorial view of an illustrative wall calendar 10. In this a wall calendar usually is composed of twelve or thirteen sheets of paper stock that are folded laterally across a center line 12 and are usually stapled along the center seam line. A top half 14 of the wall calendar 10 usually includes an image 16 and the lower or bottom half 18 depicts the days of a month of the year within an "X-Y" grid of thirty five squares reflecting a day of the week 20 and as well as a numerical date of the month. A wall calendar holder apparatus 22 in accordance with one embodiment of the invention is releaseably clamped onto a top edge of the calendar 10 and serves to provide a secure support function as well as providing an attractive upper border and/or information surface.

Referring now to FIG. 2 and FIGS. 3 through 7 there are shown detailed views of a preferred form of the subject wall calendar holder apparatus 22. The wall calendar holder comprises a base member 24 which preferably has a solid rectangular configuration with opposing relatively long first 26 and second 28 top and bottom edges and first 30 and second 32 relatively shorter end edges. In this connection the term solid rectangular means a shape that has a generally rectangular face and also a depth dimension so that the base member 24 has a three dimensional exterior configuration.

The wall calendar holder 22 also has a face member 34 which is configured as a solid rectangular form with first 36 and second 38 relatively long top and bottom opposing edges and first 40 and second 42 end edges. As shown particularly in FIG. 2 the face member 34 is pivotally connected at a top edge 38 of the face plate to a top edge 26 of the base member by a pair of hinges 44 and 46.

Figure 5:
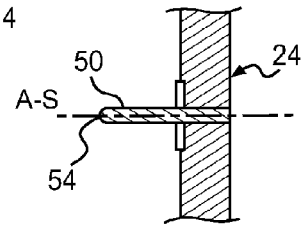
FIG. 5 is a partial cross-sectional view of a locking stanchion taken along section lines 5-5 in FIG. 3.

As shown in FIG. 5 the base member 24 carries a stanchion 50 that is press fit into an aperture in the base member 24. Alternatively a base portion of the stanchion can be formed with a screw thread and the stanchion is then screwed into an aperture in the base member to create a secure union. In a preferred embodiment the stanchion 50 comprises a generally cylindrical column that is mounted in a laterally central portion of the base member 24 and extends toward the face member 34. The face member 34 in turn is fashioned with a cylindrical cavity 52, note particularly FIG. 6, that operably receives a distal end of the stanchion 50 when the face member 24 is pivoted in the direction of arrow "A" in FIG. 6 into a general parallel but spaced posture with respect to the base member 34 as shown in FIG. 7.

In order to facilitate entry of the distal end of the stanchion 50 into a compatibly dimensioned cavity 52 an outer or distal end 54 of the stanchion is configured in the shape of a hemisphere. When the stanchion 50 of the base member 24 is engaged within the compatibly dimensioned cavity 52 in the face member 34 an imaginary central longitudinal axis A-S of the stanchion is co-axial with an imaginary central longitudinal axis A-C of the cavity 52. The hemisphere tip 54 of the stanchion permits the stanchion to be pivoted into engagement with the cavity 52 and from the position depicted in FIG. 6 of an angular position of the face member with respect to the base member shown in FIG. 7 the face member 34 snaps into a secure engagement with respect to the base member 24.

In a preferred embodiment the inside surface of the face member 34 is fitted with a pair of first 56 and second 58 columnar wall calendar engagement pads that are operable to press against the outer corners of a wall calendar. The height of the engagement pads 56 and 58 is substantially the dimension "B" as shown in FIG. 7 which is the depth of the hinges 44 and 46. The engagement pads 56 and 58 can be formed from felt material with a self adhering coating or with an elastomeric material. The engagement pads serve to hold the outer edges in a wall calendar 10 in a substantially flat posture between the base member 24 and the face member 34.

In a preferred embodiment the solid rectangular base member 24 and face member 34 are composed of wood. The outer edge of the face member or plate may be fashioned with a beveled edge as shown in FIG. 1 to enhance the appearance of the face plate. Moreover the outer surface of the face plate may be sculpted with a desirable design, brand an image onto the surface, artistically painted, or just painted for color. In addition the face plate may serve to carry advertising information such as the name of a sponsoring company. The outer surface of the face member 34 can also have an embedded or glued on metallic surface such that a magnet can be used to releaseably attach notes or business cards to the face member 34. Alternatively one or more magnets can be embedded into the back surface of the base plate so that the calendar holder can be faciley attached to a metallic surface such as a cabinet, locker, refrigerator front and the like.

The stanchion is preferably formed from a metal rod member with a stop flange for engagement with the base member and as noted above and the stanchion 50 operably snaps into engagement with a compatibly dimensioned cavity 52 in the face member to hold the face member 34 in secure engagement with the base member 24. This process operable pins the upper edges of a wall calendar hung from the distal end of the stanchion is a firm supporting relationship within and between the two opposing face and base plates of the subject wall calendar holder.

Although in a presently preferred form the subject wall calendar holder is constructed principally from wood it is envisioned that the entire apparatus can be injection molded from a plastic composition. In this event the separate hinges 44 and 46 can be formed by a reduced thickness of plastic in zones that can form a pair of separated hinge members or the reduced thickness seam can extend completely along the length of the junction of the tope edge of the face member with the base member. In this plastic molded embodiment the stanchion can be formed from a metal column force fit into an aperture in the base member or alternatively the upright stanchion can be an integral component of the plastic molded part.

The functions and advantageous of the subject wall calendar holder made from wood or plastic provides a secure and attractive holder for a wall calendar that is operable to be uses in a variety of locations and can be used with a number of calendars on a year to year basis. In describing the invention, reference has been made to a preferred embodiment. Those skilled in the art, however, and familiar with the disclosure of the subject invention may recognize additions, deletions, substitutions, modifications and/or other changes which will fall within the purview of the invention as defined in the following claims.

What is claimed is:

1. A wall calendar holder comprising:

a generally solid rectangular base member having opposing relatively long edges and opposing relatively short edges including an aperture within said base member for operably permitting engagement and support of said base member upon a generally vertical wall surface;

a generally solid rectangular face member having opposing relatively long edges and opposing relatively short edges, said face member pivotally connected to said base member at one of said opposing relatively long edges and said face member in combination with said base member being operable to secure an upper portion of a wall calendar between said base member and said face member; and a single stanchion mounted in a laterally central portion of said base member and projecting toward said face member and being operable to be received within a compatibly dimensioned cavity within said face member for releaseably hanging said wall calendar between opposing surfaces of said base member and said face member, wherein said wall calendar is releaseably hung upon said single stanchion in a generally vertical hanging posture from said single stanchion when said base member is mounted upon said generally vertical wall surface and said face member and said base member extend in a general parallel but spaced posture with said upper portion of said wall calendar operably positioned therebetween and said stanchion operably extends through a top center aperature of the wall calendar and at least partially extends into said compatibly dimensioned cavity for supporting the wall calendar in said generally vertical posture upon said wall surface, wherein said stanchion comprises a generally cylindrical column and is mounted upon said laterally central portion of said base member and extends toward said face member;

said compatibly dimensioned cavity having a generally cylindrical cavity compatibly dimensioned to receive at least a portion of said stanchion and when said face member is pivoted into said generally parallel but spaced posture with said base member a central longitudinal axis of said stanchion is coincident with a central longitudinal axis of said cylindrical cavity of said face member wherein said wall calendar to be supported by said wall calendar holder can be hung on said stanchion of said base member and then said face member can be pivoted into engagement with said wall calendar and receive said at least a portion of said stanchion within said cylindrical cavity of said face member to support the wall calendar between the base member and said face member of said wall calendar holder, wherein, said stanchion includes a hemisphere head on a distal end of said stanchion to facilitate pivotal snapping engagement of said stanchion within said cylindrical cavity and further comprising:

a first calendar engaging pad mounted upon one inside end surface of said face member and being operable to engage an edge portion of said wall calendar hung from said stanchion when said face member is pivotally closed toward said base member: and a second calendar engaging pad mounted upon the other inside end surface of said face member and being operable to engage an opposing edge portion of said wall calendar hung from said stanchion when said face member is pivotally closed toward said base member to hold the wall calendar in a generally flat condition upon said wall surface, wherein:

said pivotal connection between said face member and said base member comprises a pair of hinges mounted between an upper edge of said base member and an upper edge of said face member and wherein said pair of hinges and said engaging pads being substantially the same thickness so that said base member and said face member pivot into said generally parallel but spaced posture.

* * * * *